United States Patent [19]

Tsukada et al.

[11] 4,376,692

[45] Mar. 15, 1983

[54] DRY ETCHING DEVICE COMPRISING A MEMBER FOR BRINGING A SPECIMEN INTO ELECTRICAL CONTACT WITH A GROUNDED ELECTRODE

[75] Inventors: Tsutomu Tsukada; Katsumi Ukai, both of Fuchu, Japan

[73] Assignee: Anelva Corporation, Fuchu, Japan

[21] Appl. No.: 215,805

[22] Filed: Dec. 12, 1980

[30] Foreign Application Priority Data

Dec. 15, 1979 [JP] Japan ..... 54-162176

[51] Int. Cl.[3] ..... C23F 1/00; C23C 15/00

[52] U.S. Cl. ..... 204/298; 156/345; 156/643; 204/192 E

[58] Field of Search ..... 204/192 E, 192 EC, 298; 156/345, 643

[56] References Cited

U.S. PATENT DOCUMENTS 3,474,021 10/1969 Davidse et al. ..... 204/192

4,134,817 1/1979 Bourdon ..... 204/192 E 4,253,907 3/1981 Parry et al. ..... 156/643

4,268,374 5/1981 Lepselter ..... 204/298

4,270,999 6/1981 Hassan et al. ..... 204/192 E 4,298,443 11/1981 Maydan ..... 204/192 E

*Primary Examiner*—Aaron Weisstuch

*Attorney, Agent, or Firm*—Laff, Whitesel, Conte & Saret

[57] ABSTRACT

In a dry etching device comprising a first electrode supplied with an electrical voltage and a second electrode grounded, a dielectric plate is placed on the second electrode and includes means for positioning a specimen to be etched. The specimen is brought into electrical contact with the second electrode by the positioning means and is, therefore, substantially grounded during etching. The positioning means may be a through hole for receiving the specimen therein. Alternatively, the positioning member may be a conductive spring passing through the dielectric plate. A plurality of positioning members may be arranged in the dielectric plate.

4 Claims, 5 Drawing Figures

DRY ETCHING DEVICE COMPRISING A MEMBER FOR BRINGING A SPECIMEN INTO ELECTRICAL CONTACT WITH A GROUNDED ELECTRODE

BACKGROUND OF THE INVENTION

This invention relates to a dry etching device for etching a specimen by the use of a gas plasma.

As will later be described with reference to a few of the several figures of the accompanying drawing, a conventional dry etching device of the type described comprises a chamber defining a hollow space, a first electrode positioned in the hollow space, a second electrode opposite to the first electrode in the hollow space and electrically grounded, and a power source for applying a high frequency voltage between the first and the second electrodes to develop a gas plasma in the space between the first and the second electrodes. When placed on the first electrode, a specimen to be etched is etched at a comparatively rapid etch rate. However, the specimen should be handled with great care because the first electrode is supplied with the high frequency voltage. On the other hand, such a problem does not occur when the specimen is placed on the second electrode which is grounded. But, the etch rate becomes considerably lower as known in the art.

In addition, it is preferable to etch a specimen at a low gas pressure, in order to delineate fine patterns on the specimen, as known in the art.

SUMMARY OF THE INVENTION

It is, therefore, an object of this invention to provide a dry etching device which is capable of being easily handled without any care.

It is another object of this invention to provide a dry etching device of the type described, wherein the etch rate is increased.

It is a further object of this invention to provide a dry etching device of the type described, wherein fine patterns are delineated at low gas pressure.

A dry etching device to which this invention is applicable is used for etching a substantially conductive specimen by the use of a gas plasma. The device comprises a chamber defining therein a hollow space to be exhausted and then filled with a preselected reactive gas, a first electrode positioned in the gas-filled space and having a first surface, a second electrode placed in the gas-filled space and having a second surface opposite to the first surface, means for applying an electric voltage of a predetermined frequency to develop the gas plasma in the gas-filled space between the first and the second surfaces, and a dielectric plate member having a back surface brought into contact with the second surface and a front surface directed toward the first surface. According to this invention, the plate member includes positioning means for positioning the specimen in contact with the second surface to substantially ground the specimen.

DESCRIPTION OF THE PREFERRED EMBODIMENTS

Figure 1:
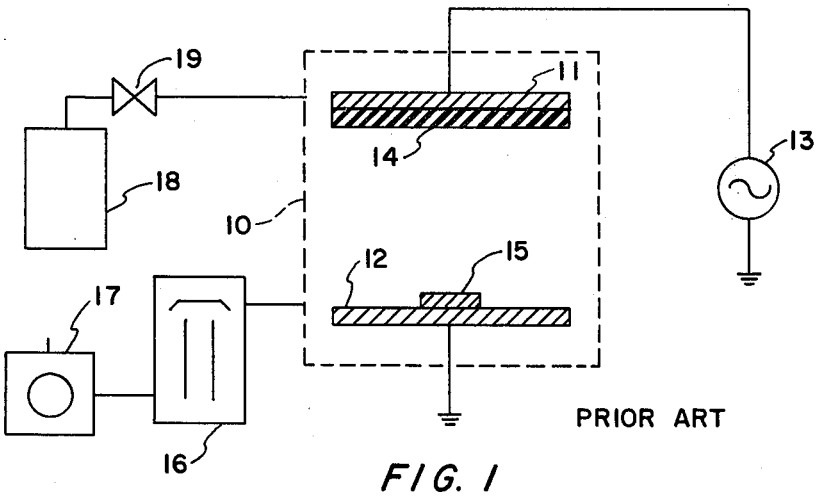
FIG. 1 shows a schematic side view of a conventional dry etching device together with a pumping system and a gas supply system.

Referring to FIG. 1, a conventional dry etching device comprises a chamber 10 defining therein a hollow space to be exhausted and then filled with a preselected reactive gas, a first electrode 11 placed in the gas-filled space and having a first surface, and a second electrode 12 placed in the gas-filled space and having a second surface opposite to the first surface. As shown in FIG. 1, the second electrode 12 is grounded. A power source 13 is connected between the first electrode 11 and the second electrode 12 to apply a voltage of preselected high frequency and to develop the gas plasma in the gas-filled space between the first and the second surfaces. The high frequency is selected between several hundreds of kilohertz and several tens of megahertz. A dielectric plate 14 of, for example, quartz is attached to the first surface. A specimen 15 is laid on the second surface to be etched within the gas-filled space by the use of a gas plasma. Herein, the specimen 15 may be a metal or a semiconductor which is described as a substantially conductive material throughout the instant specification.

In FIG. 1, a diffusion pump 16 is connected to the chamber 10 and to a rotary pump 17 in series. The diffusion pump 16 and the rotary pump 17 serve as a pumping system for exhausting the hollow space. A gas reservoir 18 containing reactive gas is connected to the chamber 10 through a mass flow controller or valve 19. The gas reservoir 18 and the mass flow controller 19 serve as a feeding system for feeding the reactive gas to the chamber 10. As the reactive gas, carbon tetrafluoride, carbon tetrachloride, or the like may be used. When the carbon tetrachloride is used, the reservoir 18 should be heated to vaporize the carbon tetrachloride.

In the example being illustrated, the specimen 15 is brought into contact with the second electrode 12 and is consequently substantially grounded even when the gas plasma is developed between the first and the second electrodes 11 and 12 by applying the electric voltage therebetween. However, the etch rate is low in the dry etching device, as known in the art.

Figure 2:
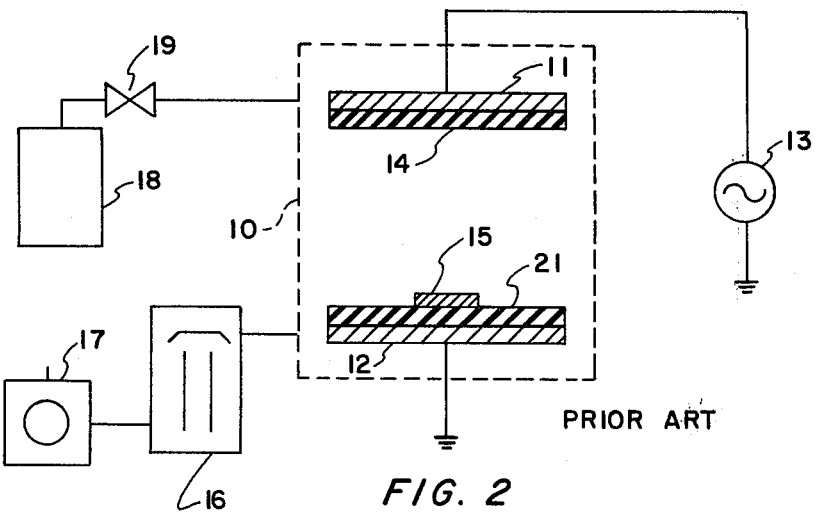
FIG. 2 shows a similar view of another conventional dry etching device.

Referring to FIG. 2, another conventional dry etching device comprises similar parts designated by like reference numerals except that an additional plate 21 of a dielectric material, such as quartz, is placed on the second electrode 12. The additional dielectric plate 21 has a back surface brought into contact with the second surface of the second electrode 12 and a front surface directed toward the first surface of the first electrode 11. The dielectric plate 21 serves to emit secondary electrons when the plate 21 is bombarded by the gas plasma. The secondary electrons activate dissociation of the reactive gas filled in the hollow space and help to etch the specimen 15. Herein, it should be noted that the specimen 15 is insulated from the second electrode 12 by the dielectric plate 21 between the specimen 15 and the second electrode 12. This means that the effective potential of the specimen 15 is varied during the etching process. It has been experimentally found by the inventors that the variation of the effective potential is dependent on a thickness of the dielectric plate 21 and inversely affects the etch rate of the specimen 15 when the dielectric plate 21 is thicker than about 1 mm. Since the dielectric plate 21 is about 3 mm thick, a reduction in the energy of ions bombarding the specimen 15 is inevitable. Thus, it is also difficult with the conventional etching device to increase the etch rate.

Figure 3:
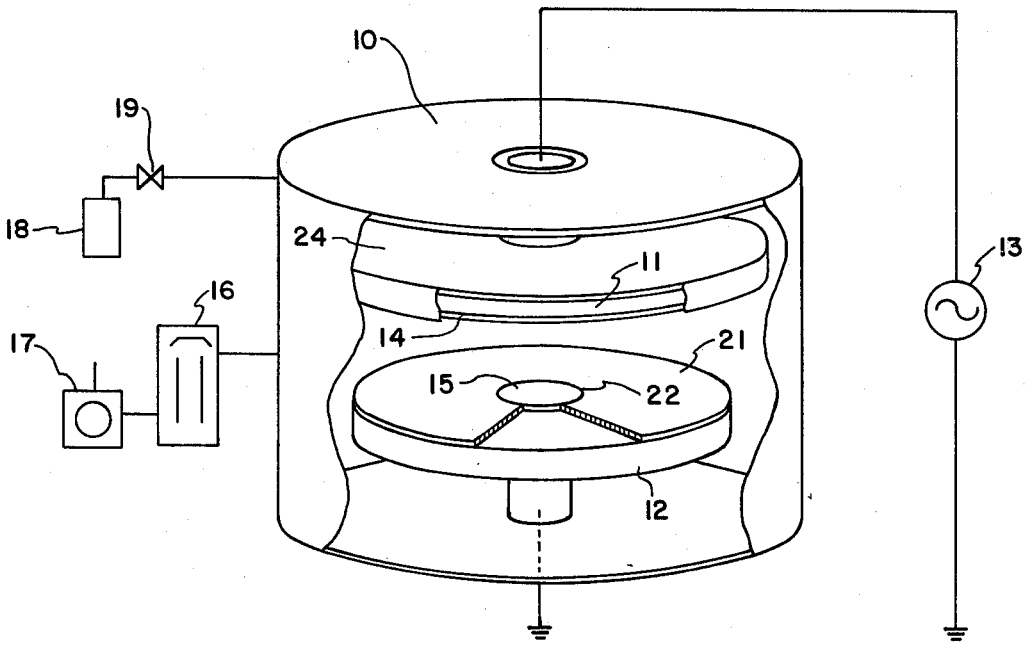
FIG. 3 shows a perspective view of a dry etching device according to a first embodiment of this invention, with a part cut away, together with pumping and gas supply systems.

Referring to FIG. 3, a dry etching device according to a first embodiment of this invention is similar to that illustrated with reference to FIG. 2 except that the dielectric plate 21 has an internal side surface defining a through hole 22. In the example being illustrated, the dielectric plate 21 is of quartz and has the through hole 22 somewhat larger in size than the specimen 15 and a thickness substantially equal to that of the specimen 15. In the through hole 22, the specimen 15 is positioned to be brought into electrical contact with the second electrode 12. It thus is readily understood that the dielectric plate 21 constitutes a positioning member for positioning the specimen 15 in contact with the second surface of the second electrode 12 to substantially ground the specimen 15. In addition, a conductive shield plate 24 covers the first electrode 11 with the first surface remaining uncovered and with a small gap left between the shield plate 24 and the first electrode 11. Although omitted from FIGS. 1 and 2, the shield plate 24 is also present in each of the conventional dry etching devices in order to prevent a parasitic gas plasma from appearing on the rear side of the first electrode 11.

It is assumed that a specimen 15 of aluminum is positioned in the through hole to be etched by the device according to the embodiment and carbon tetrachloride is fed, as the reactive gas, into the chamber 10 from the gas reservoir 18 through the mass flow controller 19. Under the circumstances, the power source 13 of 13.56 MHz is energized to develop the gas plasma in the space between the first and the second electrodes 11 and 12. The specimen 15 is etched by the gas plasma, being kept substantially at the ground potential. Therefore, variation of the effective potential on the specimen 15 is substantially negligible with the device according to the first embodiment. This means that the specimen 15 is bombarded by high energy ions of the gas plasma. Further, a great deal of secondary electrons are emitted from the additional dielectric plate 21 surrounding the specimen 15. Since the secondary electrons serve to activate the dissociation of the reactive gas, a high etch rate is obtained even when pressures of the reactive gas are low.

In addition, the specimen 15 is surrounded by the additional dielectric plate 21. The electric field, therefore, becomes substantially uniform on that surface of the specimen 15 which is opposite to the first electrode 11. As a result, the specimen 15 is uniformly etched on the surface thereof.

Figure 4:
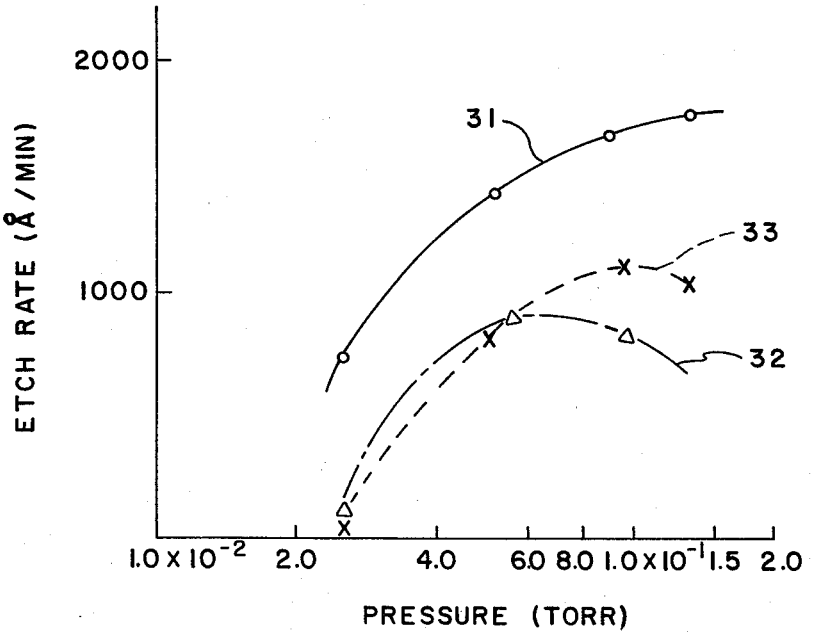
FIG. 4 shows pressure versus etch rate characteristics of the dry etching devices illustrated in FIGS. 1 through 3.

Referring to FIG. 4, wherein the abscissa and the ordinate represent pressure (in Torr) of the carbon tetrachloride gas and etch rate (angstrom/minute), respectively, curve 31 shows a pressure versus etch rate characteristic of the dry etching device according to the first embodiment illustrated in FIG. 3 while curves 32 and 33 show similar characteristics of the conventional devices illustrated by FIGS. 1 and 2, respectively. Herein, use was made of a 13.56 MHz power source and electric power of 150 watt was applied between the first and the second electrodes 11 and 12. As shown in FIG. 4, the dry etching device according to the first embodiment has a considerably higher etch rate than the conventional devices. Therefore, the dry etching device according to the device is usable even when the pressure of the reactive gas is extremely low.

Figure 5:
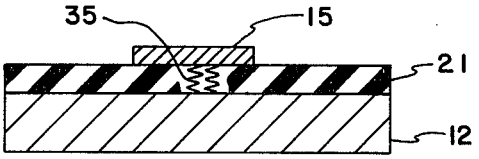
FIG. 5 is a partial radial sectional view of a dry etching device according to a second embodiment of this invention.

Referring to FIG. 5, a dry etching device according to a second embodiment of this invention comprises, as the positioning member, a conductive spring 35 passing through the dielectric plate 21 to electrically ground the specimen. With the second embodiment, it is also possible to achieve a characteristic similar to that illustrated by the curve 31 in FIG. 4. Alternatively, the conductive spring 35 may be located within a through hole smaller in size than the specimen 15.

While this invention has thus far been described in conjunction with a few preferred embodiments thereof, it is readily possible for those skilled in the art to practice this invention in various manners. For example, the specimen 15 may equivalently be grounded at the high frequency. Therefore, a thin dielectric film, which acts as a substantial conductor in the high frequency, may be attached to at least one surface of the specimen 15 and the second electrode 12. As the dielectric plate, use is possible of a glass plate, a ceramic plate, or the like. The dielectric plate 21 may be accompanied by a plurality of positioning members to electrically ground a plurality of specimens.

What is claimed is:

1. A dry etching device for etching a substantially conductive specimen by the use of a gas plasma, said device comprising a chamber defining therein a hollow space adapted to be exhausted and then filled with a preselected reactive gas; a first electrode positioned in said space and having a first surface; a second electrode positioned in said space and having a second surface opposite to said first surface; means for applying an RF voltage of predetermined frequency to said first electrode with said second electrode grounded to thereby develop said gas plasma in said space between said first and said second surfaces; and a dielectric plate member having a back surface brought into contact with said second surface and a front surface directed towards said first surface, the improvement wherein said plate member includes positioning means for positioning said specimen in contact with said second surface to substantially ground said specimen.

2. A dry etching device as claimed in claim 1, wherein said positioning means has an internal side surface defining a through hole in which said specimen is to be received.

3. A dry etching device as claimed in claim 1, wherein said positioning means comprises a conductive spring passing through said plate member to electrically ground said specimen.

4. A dry etching device as claimed in claims 1, 2, or 3, wherein said etching device comprises a further plate member on said first surface.

* * * * *